United States Patent [19]

Klingel

[11] Patent Number: 4,569,267

[45] Date of Patent: Feb. 11, 1986

[54] MULTITOOL PUNCH MECHANISM

[75] Inventor: Hans Klingel, Moeglingen, Fed. Rep. of Germany

[73] Assignee: Trumpf GmbH & Co., Ditzingen, Fed. Rep. of Germany

[21] Appl. No.: 546,745

[22] Filed: Oct. 28, 1983

[30] Foreign Application Priority Data

Nov. 6, 1982 [DE] Fed. Rep. of Germany ..... 3241046

[51] Int. Cl.[4] ..... B21D 28/02

[52] U.S. Cl. ..... 83/552; 83/549; 234/111

[58] Field of Search ..... 83/549, 552; 234/111–114, 116–118

[56] References Cited

U.S. PATENT DOCUMENTS

| | | | |
|---|---|---|---|
| 1,926,985 | 9/1933 | Podrabsky | 83/552 |
| 3,325,096 | 6/1967 | East | 234/111 X |
| 3,392,913 | 7/1968 | Neilsen | 83/549 X |
| 3,518,908 | 7/1970 | Daniels . | |
| 3,600,998 | 8/1971 | Palmer . | |
| 3,685,380 | 8/1972 | Daniels . | |
| 4,091,700 | 5/1978 | Cloup . | |
| 4,096,774 | 6/1978 | Kaufmann . | |
| 4,136,592 | 1/1979 | Beatty . | |
| 4,182,022 | 1/1980 | Kristiansson . | |
| 4,220,062 | 9/1980 | Blanz . | |
| 4,250,784 | 2/1981 | Bredow . | |
| 4,250,785 | 2/1981 | Morishita et al. . | |
| 4,341,137 | 7/1982 | Heitch et al. . | |

FOREIGN PATENT DOCUMENTS

| | | | |
|---|---|---|---|
| 219119 | 2/1910 | Fed. Rep. of Germany | 83/549 |
| 239994 | 10/1911 | Fed. Rep. of Germany | 83/549 |
| 134371 | 11/1919 | United Kingdom . | |
| 200439 | 7/1923 | United Kingdom | 83/549 |

*Primary Examiner*—Frank T. Yost

[57] ABSTRACT

A punch press uses a punch tool assembly which contains at least two punch pins of different diameters or cross-sections which are readily interchangeable in the working position by a control element which is slidable about the pin support member, and actuating means. When the punch tool assembly is rotatable about the ram to effect the movement of the punch pins from operative to inoperative positions, then a cooperating movable die is provided in order to ensure that the aligned die bores are cooperatively dimensioned and configured with respect to the punch pins.

16 Claims, 6 Drawing Figures

MULTITOOL PUNCH MECHANISM

BACKGROUND OF THE INVENTION

The present invention relates to punch presses utilizing at least two independently movable punch pins which may be moved between operative and inoperative positions.

Conventional punch presses which use a punch assembly having one punch and one mating die require the changing of the entire punch tooling whenever a different die diameter or configuration is to be put to use. A number of punch presses employ magazines which contain a number of different size punches and dies and include means for effecting relatively rapid change of the punch and die assembly in the operative station of the punch press. Some such apparatus utilizes automatic tool changing whereas others require manual tool changing. Still other presses employ turrets containing different tooling at spaced locations thereabout and effect indexing to orient the desired tooling with the workpiece.

Even in such magazine and turret type punch presses, there is a limited number of combinations of dies and punches which can be satisfactorily employed and there are substantial space considerations with respect to the size of the magazines and the automatic elements for effecting the changing of the tooling in the operative punch station, or with respect to the size of the turret in turret type machines.

It is an object of the present invention to provide a novel punch press which includes a punch tool assembly with at least two punch pins aligned with the ram and which are movable between operative and inoperative positions rapidly and effectively.

It is also an object to provide such a novel punch press in which the punch tool assembly tooling remains in relatively constant position relative to the punch ram and wherein the movement of the punch pins between operative and inoperative positions is effected by relatively simple and effective control means.

Another object is to provide such a novel punch press wherein the operative punch pin is disposed relatively closely to the geometric axis of the ram.

Still another object is to provide such a novel punch press in which the movement of the punch pins from operative to inoperative positions may be readily and rapidly effected by the control mechanism for the punch press without the necessity for changing the tools in alignment with the ram.

SUMMARY OF THE INVENTION

It has now been found that the foregoing and related objects may be readily obtained in a punch press which includes a housing in which is reciprocally mounted a ram, and a punch tool assembly which includes a support member having bores in which are movably supported at least two punch pins each having a working end adapted to strike the workpiece and an opposite end for movement along axes parallel to the axis of reciprocation of the ram. They are movable from a working position in which their working ends will impact upon the workpiece to an elevated or at rest position. The punch assembly also includes means for moving the pins from the working position to the elevated position, and control means for moving a selected one of the punch pins to the working position and locking it in the working position and for disposing the other of the punch pins in the elevated position.

In accordance with the preferred embodiment of the invention, the control means acts upon the opposite ends of the punch pins to effect the movement to the working position, and the selected one of the punch pins which is disposed in the working position has its other end substantially coplanar with the inner end of the bore in which it is movably supported. The control means also extends substantially coplanar with the inner end of the bore.

Desirably, the other ends of the punch pins in their elevated position project outwardly from their bores and can be retained in this position. Generally, the punch assembly includes spring means biasing the punch pins into the elevated position.

The control means may include a control element slidably supported on the support member and having at least one recess therein receiving the other end of the other punch pins when in their elevated position. In one embodiment, this slidable control element can be displaced transversely to the direction of movement of the punch pins and the control means will include means for retaining the control element in various positions along this axis of transverse displacement. Generally, the control means will include an actuator for the slidable control element supported on either the punch ram or the housing so as to effect the movement of the slidable control element. In one form of the invention, two punch pins are associated with each of such slidable elements and the recess in the slidable elements is dimensioned to receive therewithin the other ends of both of the punch pins.

In another form of the invention, the slidable element is mounted on the support member for rotation around an axis parallel to the direction of movement of the punch pins. The rotational axis of the slidable member may be coaxial with the geometric axis of the punch ram. The slidable member may be of generally annular cross section and an attaching pin on the support member may extend therethrough to lock the punch tooling on the ram.

The control means may include a control element which is unitary with the end of the ram adjacent to the support member, and the punch assembly may be mounted to rotate on the ram. In such a form, the press may include a die mounted to rotate synchronously with the punch assembly so that the cooperating bores in the die are aligned with the punch pins.

In still another form of the present invention, the punch assembly may be mounted for rotation on the ram about an axis displaced from the geometric axis of the ram, and the geometric axis of the selected punch pin disposed in the working position will coincide with the geometric axis of the ram. The control means may include an element having an attaching pin on one surface for locking it on the ram and a shaft on its other surface parallel to and laterally displaced from the axis of the attaching pin to provide the rotational support for the punch assembly thereon.

In the rotational forms of the control means, the control element will generally have a recess therein in the form of a circular arc in which is received the other end of the punch pins in their elevated positions.

DETAILED DESCRIPTION OF THE ILLUSTRATED EMBODIMENTS

Figure 1:
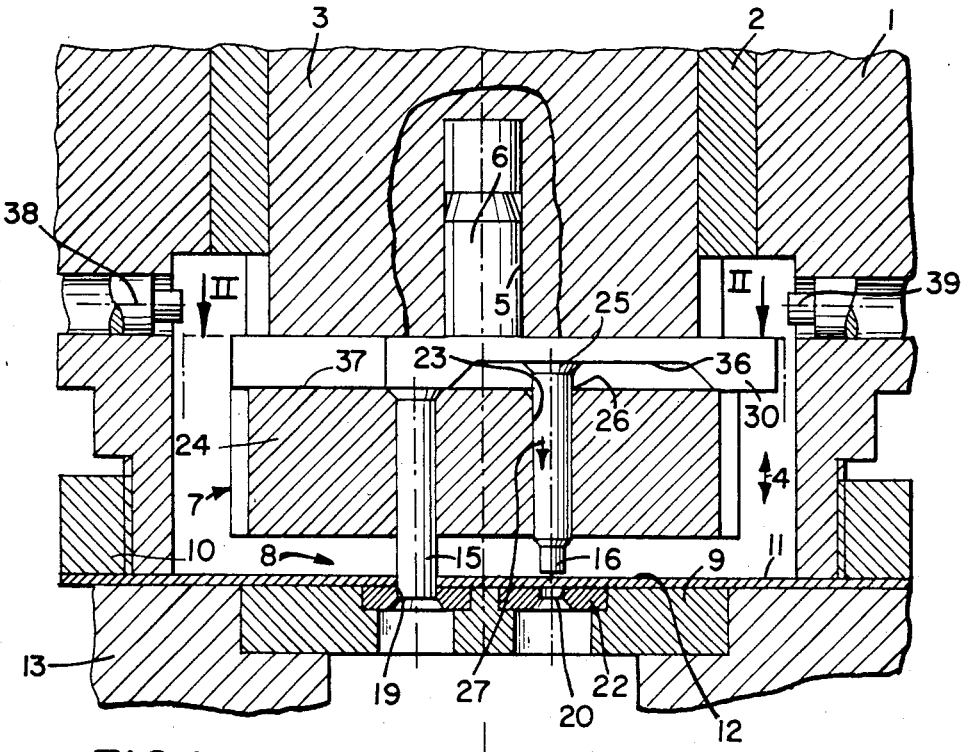
FIG. 1 is a fragmentary vertical cross-section through the punch press at the punching station showing a tool mechanism embodying the present invention.

Turning now in detail to the attached drawings, therein illustrated is a punch press which in the several embodiments includes a punch housing 1 with a guide bearing 2 in which the ram 3 is reciprocable in both directions as shown by the double-headed arrow 7. To effect reciprocation of the ram 3 there is a conventional drive mechanism (not shown) such as an eccentric drive mechanism. Centrally of the ram 3 is a ram bore 5 which extends inwardly from its lower face, and this seats the locking pin 6 of the punch pin subassembly or tool 7. This locking pin 6 will normally be automatically locked in the ram 3 by conventional means (not illustrated) to facilitate punch tool changing.

As is conventional, the punch pin assembly 7 cooperates with a readily changeable die 9 seated in a recess in the machine table 13 under the ram 3, to provide a two piece punch tool assembly 8. A retainer (not shown) may also be provided on the punch pin assembly 7 to form a three-piece punch tool assembly.

Seated on the upper or support surface 12 of the machine table 13 is a workpiece 11, and a stripper 10 (seen only in FIG. 1) is desirably provided on the punch housing 1 to hold the workpiece 11 against the surface 12 and keep it from rising as the ram 3 moves in its upward stroke.

Figure 2:
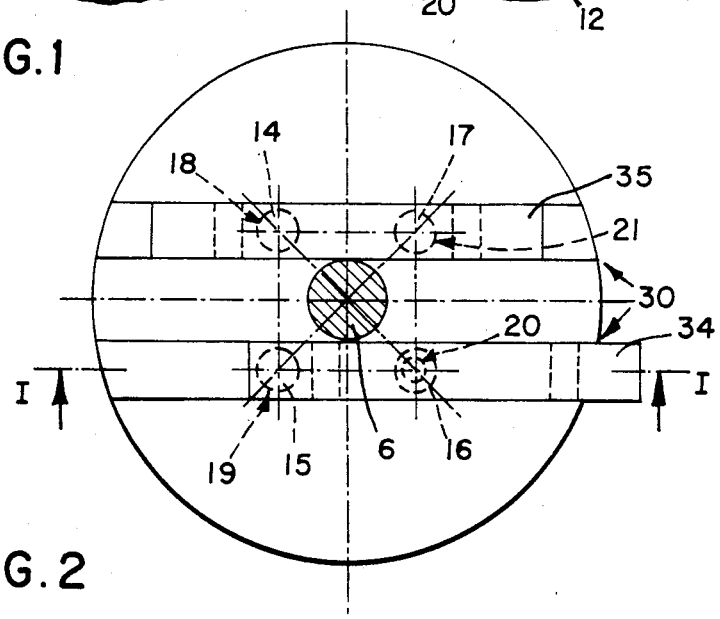
FIG. 2 is a cross-sectional view along the line II—II of FIG. 1.

Turning now in detail to the embodiment of FIGS. 1 and 2, the punch pin assembly 7 includes a base block or pin housing 24 having four punch pins 14, 15, 16 and 17 reciprocable in the direction of the double arrow in the bores 23 thereof which are symmetrically arranged about the axis of reciprocation of the ram 3. The punch pins 14–17 have flanges or conical collars 25 at their inner or upper ends which will seat in cooperatively configured recesses 26 at the upper surface of the bores 23 of the base block 24 to prevent the pins 14–17 from falling through the bores 23 in the punching direction shown by the arrow 27. The punch pins 14–17 may be of uniform diameter through their entire length or have reduced diameter portions or non-circular cross-section portions at their working end as in the case of the punch pin 16. Not illustrated in this embodiment are the spring means for normally urging the punch pins 14–17 upwardly or away from the workpiece 11.

The die 9 has a series of openings therethrough in which are seated hardened metal inserts 22 providing die bores 18, 19, 20 and 21 dimensioned are configures to cooperate with the working ends of the punch pins 14–17 so that the punch pins will closely reciprocate therewithin, as seen with respect to the punch pin 15.

The punch pins 14–17 are movable axially into a lowered, working position such as that of the pin 15 and into their at rest or disengaged position by a control mechanism 30 which includes a pair of control slides 34, 35 transversely movable rectilinearly and parallel to one another along axes perpendicular to the longitudinal axes of the punch pins 14–17. The control slide 34 extends across the upper ends of the punch pins 15 and 16, and the slide 35 across the upper ends of the punch pins 14 and 17. As best seen in FIG. 2, the pins 14 and 17 are arranged concentrically about the axis of the ram 3 to define the corners of an imaginary square.

Each of the control slides 34, 35 has a recess 36 in its lower surface into which the upper ends of the punch pins 14–17 extend in the at rest position as seen with respect to the punch pin 16 in FIG. 1. The ends of the recess 36 are inclined to provide a smooth camming action to urge the pins 14–17 downwardly as the unrecessed portion of the slides 34, 35 is moved thereover.

As seen in FIG. 2, the slide 35 is in an intermediate position relative to its path of travel, and both punch pins 14, 17 are thus able to move into their at rest position in its recess 36. The slide 34 is at the right hand side of its path of travel so that the punch pin 15 is pushed downwardly by its unrecessed end portion while the punch pin 16 is able to move upwardly into the at rest position within its recess 36.

Movement of the control slides 34, 35 is effected by the shifting mechanisms 38, 39 which are only schematically illustrated and which may be engaged with and move the slides by pneumatic, hydraulic or electrical actuation. As will be appreciated, they must effect lateral movement in both directions, and must not interfere with the reciprocation of the ram 30. Conveniently, their engagement with the slides 34, 35 may occur only when the ram 3 moves upwardly to its upward, dead center position. At this time, the shifting mechanisms 38, 39 may move inwardly to engage and move the control slides 34, 35. Such control and movement may be readily effected by the automatic controls generally employed in such punch presses.

If so desired, mechanical interengagement of the slides 34, 35 such as by a dovetail or T-lock, may be replaced by magnetic coupling sufficiently strong to prevent disengagement when the slide engages a punch pin and is required to move against the biasing pressure of its spring. Moreover, opposed shifting mechanisms may be employed for each slide so that only simple pushing action is required.

Figure 3:
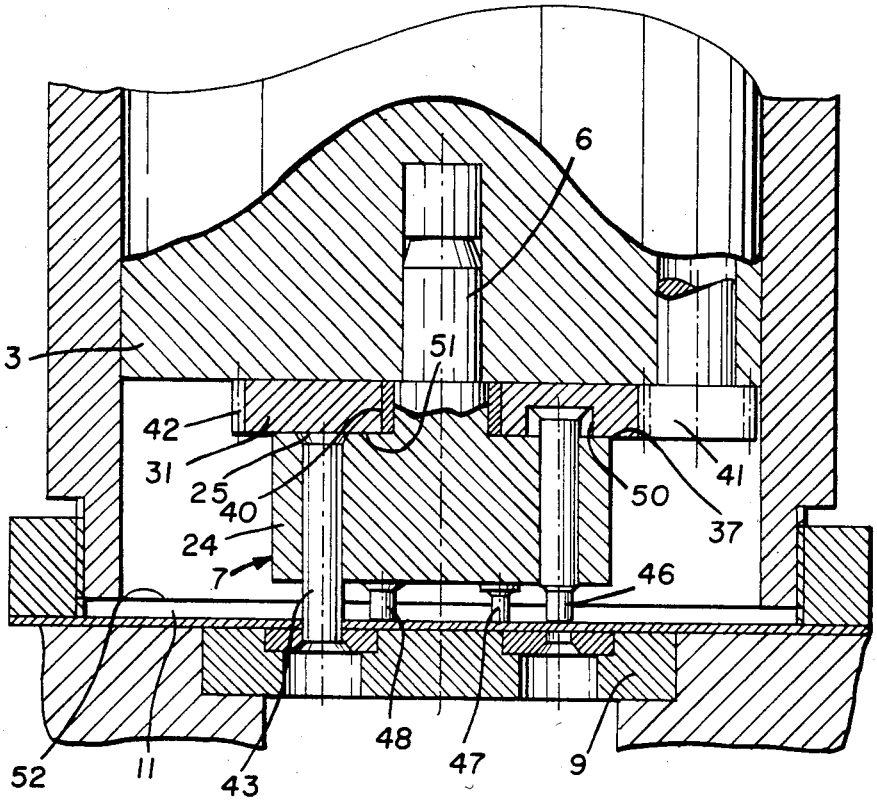
FIG. 3 is a fragmentary vertical cross-section similar to FIG. 1 of a punch press employing a second embodiment of the inventive tool mechanism.
Figure 4:
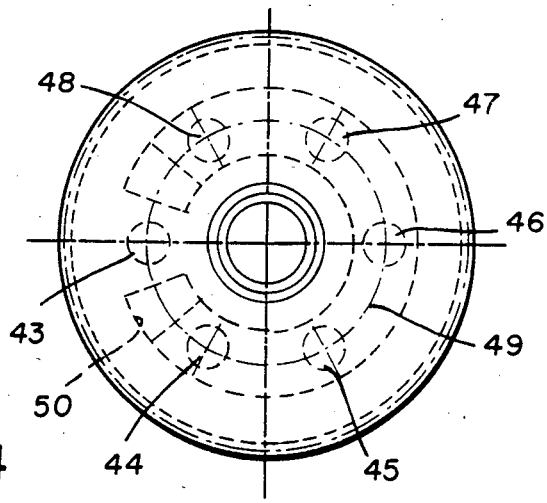
FIG. 4 is a cross-sectional view along the line IV—IV of FIG. 3.

Turning now to the embodiment of FIGS. 3 and 4, the control mechanism uses a slide 31 which moves arcuately and concentrically about the geometric axis of the ram 3 rather than rectilinearly and transversely. The slide 31 is of generally annular or ring-like cross-section and is provided with teeth 42 about its outer periphery. It rotates on the upper surface 37 of the base block 24 about a central bearing 40, and is rotatable by its driving engagement with the pinion gear 47 which is journalled in the ram 3.

In this embodiment, six punch pins 43–48 are concentrically arrayed in bores in the base block or pin housing 26 below the slide 31, and an arcuate recess 50 in the slide 31 extends to an included angle of more than 300°. Inclined camming surfaces are provided at the ends of the recess 50. Five pins 44–48 are in their upward at rest position within the recess 50, and the sixth pin 43 is pushed downwardly into the working position by the unrecessed portion of the slide 41. Thus, only the punch pin 43 will come into contact with the upper surface 52 of the workpiece 11 at the bottom of the work stroke, as seen in FIG. 3. Rotation of the pinion gear 41 may be readily effected by the control mechanism for the press.

Figure 5:
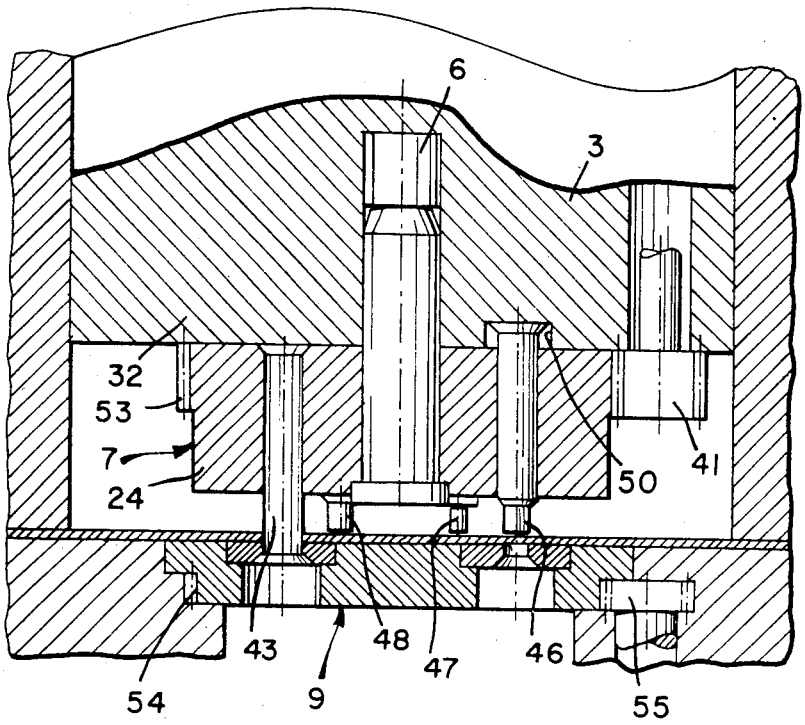
FIG. 5 is a fragmentary vertical cross-section similar to FIGS. 1 and 3, of a punch press employing another embodiment of the inventive tool mechanism.

Turning now to the embodiment of FIG. 5, the lower portion of the ram 3 is configured to provide the control mechanism 32 as a unitary part thereof. Alternatively, a separately formed member may be affixed thereto.

The punch pins 43–48 are similarly arrayed and supported in the base block or pin housing 24. However, the circumference of the base block 24 is provided with teeth 53 which are drivingly engaged with the pinion gear 41, and the base block 24 rotates about the locking pin 6 on the ram 3. The lower surface of the ram 3 has an arcuate recess 50 therein similar to that in the embodiment of FIGS. 3 and 4 and, as the base block 24 rotates, various of the punch pins 43–48 will move into the at rest position therewithin or outwardly thereof into the working position shown for the pin 43 in FIG. 5.

In this embodiment, the die 9 must rotate to maintain the alignment of the punch pins 43–48 with the cooperating die inserts. Accordingly, the die 9 is provided with teeth 54 about its circumference, and the pinion gear 55 is drivingly engaged therewith. The two pinion gears 41, 55 preferably rotate simultaneously at the same speed and in the same direction of rotation.

Figure 6:
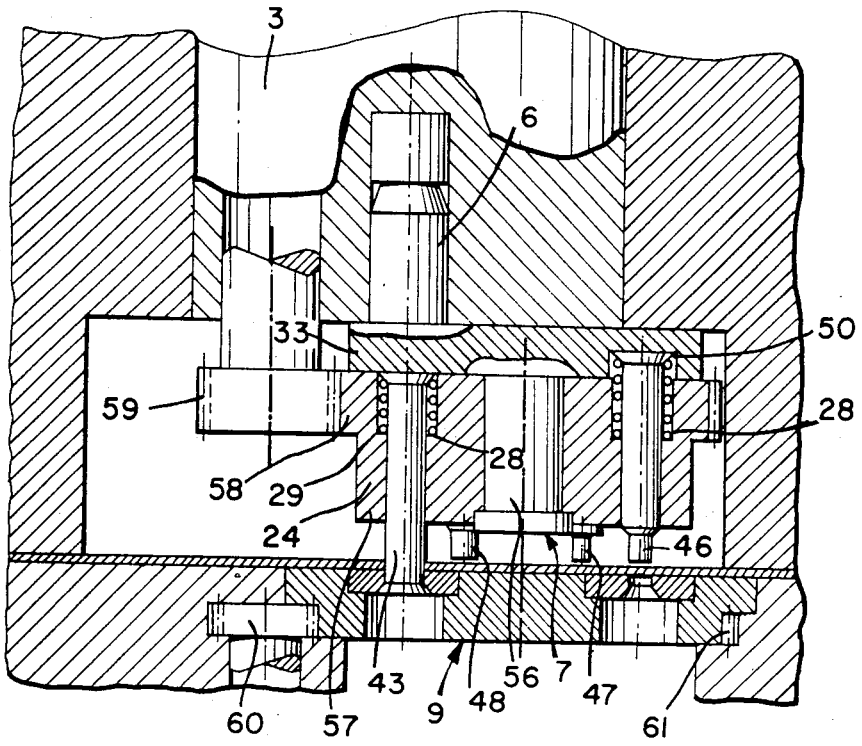
FIG. 6 is a similar view of still another embodiment of the inventive tool mechanism.

Turning finally to the embodiment of FIG. 6, the control member 33 is separately formed and has a locking pin 6 on its upper surface which non-rotatably seats in the ram 3. On its lower surface and laterally displaced from the axis of the locking pin 6 is a journal pin or shaft 56 and upon which is rotatably mounted the base block or pin housing 24. The punch pins 43–48 are disposed concentrically about the axis of the shaft 56, and their axes lie in a circle which intersects the axis of the ram 3. As seen in FIG. 6, the punch pin 43 is coaxial with the locking pin 6 and the ram 3.

The upper circumference of the base block 24 is provided with teeth 58 which are drivingly engaged with the pinion gear 59 which is journalled in the ram 3. Since the arcuate recess 50 in the lower surface of the control member 33 terminates at points spaced from the geometric axis of the ram, a punch pin rotated into the coaxial position will be pushed downwardly into the working position as seen for the punch pin 43, while the remaining pins 44–48 are disposed upwardly in the at rest position within the recess 50.

The die 9 is similarly laterally offset from the geometric axis of the ram 3 and is mounted for rotation about an axis concentric with the axis of the shaft 55 by engagement of its circumferential teeth 61 with the pinion gear 60.

Specifically illustrated in this embodiment are enlarged counterbores 29 at the upper end of the base block 24 in which are seated compression springs 28 which act against the collars 25 at the top of the punch pins 43–48 to bias them upwardly into the at rest position. Thus, in this embodiment, the operative punch pin and its cooperating die are always coaxially aligned with the geometric axis of the ram.

Although punch presses embodying the present invention will generally utilize only a single pin in the operative or working position, it is possible by multiple slide members or by proper configuration and dimensioning of the recesses to place two or more punch pins in the working position so as to provide multiple punch pins in the working position.

As will be readily appreciated the punch pins may not only only vary in cross-sectional diameter but also in cross-sectional configuration so as to provide the maximum versatility in the type of punching or nibbling which can be effected thereby.

Since the punch pins that are not in use are effectively precluded from inpingement upon the surface of the workpiece, they are more likely to enjoy longer life and minimize undesired effect upon the workpiece as it moves under the punch tooling.

As will be readily appreciated from the several illustrated embodiments, the operative punch pin is either aligned with the geometric axis of the ram or spaced only a short distance therefrom so as to minimize zero point correction in numerical control and other types of control mechanisms for movement of the workpiece relative to the punching station. Moreover, maintaining this close orientation of the axis of the punch pin to the ram geometric axis tends to provide improved life and wear characteristics for both the punch pins and dies and the punch press itself.

In numerically controlled and other automatically controlled punch presses, the indexing, rotation or slide operation may be readily effected by the machine control mechanism in accordance with preestablished criteria for any given part. Thus, all the advantages of high speed automatic operation are readily available since the punch assembly and control means of the present invention will readily fit into the spacing requirements for the tooling of existing punch presses of the type involved.

Although other means may be employed for biasing the punch pins into their elevated or at rest position, compression springs have generally been found most suitable. Other techniques that may be employed are hydraulic and pneumatic force, cam surfaces engageable with a projecting portion on the head of the punch pins, and the like.

From the foregoing detailed description and the attached drawings, it can be seen that the present invention provides a unique and highly effective punch press affording facile substitution of one punch tool for another while at the same time moving the adjacent punch pins into an inoperative position to prevent their wear and their possible injury to the surface of the workpiece. The control mechanism for effecting rapid interchange of the operative punch pins is relatively simple and effective. Moreover, the punch pins may be located closely adjacent the geometric center of the ram so as to minimize the correction necessary for the automatic workpiece movement control.

Having thus described the invention, I claim:

1. In a punch press, the combination comprising:

A. a housing;

B. a ram reciprocably mounted in said housing;

C. a punch assembly removably supported on said ram and including a punch pin support member underlying said ram, at least two punch pins disposed within bores in said support member and aligned with said ram, said pins each having a working end adapted to strike the associated workpiece and an opposite end being movable within said bores along axes parallel to the axis of reciprocation of said ram from a working position to an elevated at rest position, and means for moving said pins from said working position to said elevated position; and D. control means for moving a selected one of said punch pins to said working position and locking it in such working position and concurrently operable to dispose the others of said pins in said elevated position so that only the selected one of said punch pins is in a working position.

2. The punch press in accordance with claim 1 wherein said control means acts upon said opposite ends of said punch pins.

3. A punch press in accordance with claim 2 wherein said selected one of said punch pins has its other end substantially coplanar with the inner end of the bore in which it is movably supported, and wherein the control means lies substantially coplanar with said inner end of said bore.

4. The punch press in accordance with either of claims 1 or 2 wherein said other ends of said punch pins in the elevated at rest position project outwardly from their bores and are retained in the elevated position.

5. The punch press in accordance with claim 4 wherein said punch assembly includes spring means biasing said punch pins into said elevated at rest position.

6. The punch press in accordance with claim 1 wherein said control means includes a control element slidably supported on said support member and having at least one recess therein receiving said other end of said other punch pin in said elevated position.

7. The punch press in accordance with claim 6 wherein said slidable control element is displaceable transversely to the direction of movement of said punch pins.

8. The punch press in accordance with either of claims 6 or 7 wherein said control means includes an actuator for the slidable control element supported on one of said punch ram and said housing.

9. The punch press in accordance with either of claims 6 or 7 wherein two punch pins are associated with each slidable control element, and wherein said recess is dimensioned to receive therewithin the other ends of both of said punch pins simultaneously.

10. In a punch press, the combination comprising:

A. a housing;

B. a ram reciprocably mounted in said housing;

C. a punch assembly including a punch pin support member, at least two punch pins each having a working end adapted to strike the associated workpiece and an opposite end disposed within bores in said support member, said pins being movable within said bores along axes parallel to the axis of reciprocation of said ram from a working position to an elevated at rest position, and means for moving said pins from said working position to said elevated position; and D. control means for moving a selected one of said punch pins to said working position and locking it in such working position and for disposing the other of said pins in said elevated position, said control means including a control element slidably supported on said support member and having at least one recess therein receiving said other end of said other punch pin in said elevated position, said slidable element being mounted on said support member for sliding rotation about an axis parallel to the direction of movement of said punch pins.

11. The punch press in accordance with claim 10 wherein the rotational axis of such slidable member is coaxial with the geometric axis of said punch ram.

12. The punch press in accordance with claim 11 wherein said slidable member is of generally annular cross-section and said support member has an attaching pin extending through the center thereof to lock said punch assembly on said ram.

13. In a punch press, the combination comprising:

A. a housing;

B. a ram reciprocably mounted in said housing;

C. a punch assembly mounted on said ram for rotation thereabout and including a punch pin support member, at least two punch pins each having a working end adapted to strike the associated workpiece and an opposite end disposed within bores in said support member, said pins being movable within said bores along axes parallel to the axis of reciprocation of said ram from a working position to an elevated at rest position, and means for moving said pins from said working position to said elevated position;

D. control means for moving a selected one of said punch pins to said working position and locking it in such working position and for disposing the other of said pins in said elevated position, said control means including a control element unitary with the end of said punch ram adjacent said support member; and E. a die mounted to rotate synchronously with said punch assembly to locate the cooperating die bores thereof in alignment with the cooperating punch pins.

14. In a punch press, the combination comprising:

A. a housing;

B. a ram reciprocably mounted in said housing;

C. a punch assembly rotatably mounted on said ram and including a punch pin support member, at least two punch pins each having a working end adapted to strike the associated workpiece and an opposite end disposed within bores along axes parallel to the axis of reciprocation of said ram from a working position to an elevated at rest position, and means for moving said pins from said working position to said elevated position, the axis of rotation of said punch assembly on said ram being displaced from the geometric axis of said ram whereby the geometric axis of the selected punch pin in the working position coincides with the geometric axis of said ram; and D. control means for moving a selected one of said punch pins to said working position and locking it in such working position and for disposing the other of said pins in said elevated position wherein said control means includes an element having an attaching pin on one surface locking it on said ram and a shaft on its other surface parallel to and laterally displaced from the axis of said attaching pin to provide the rotational support for said punch assembly.

15. The punch press in accordance with either of claims 13 or 14 wherein said control means includes a control element having a recess therein in the form of a circular arc receiving said other end of said punch pins in the elevated position thereof.

16. In a punch press, the combination comprising:

A. a housing;

B. a ram reciprocably mounted in said housing;

C. a punch assembly removably supported on said ram and including a punch pin support member, at least two punch pins each having a working end adapted to strike the associated workpiece and an opposite end disposed within bores in said support member, said pins being movable within said bores along axes parallel to the axis of reciprocation of said ram from a working position to an elevated at rest position, and means for moving said pins from said working position to said elevated position; and D. control means for moving a selected one of said punch pins to said working position and locking it in such working position and operable to dispose the other of said pins in said elevated position, said control means including a control element slidably supported on said support member for rotation about an axis parallel to the direction of axis of movement of said punch pins.

* * * * *